US005380068A

United States Patent [19]

Raghavan

[11] Patent Number: 5,380,068

[45] Date of Patent: Jan. 10, 1995

[54] DEEP KERFING IN ROCKS WITH ULTRAHIGH-PRESSURE FAN JETS

[75] Inventor: Chidambaram Raghavan, Kent, Wash.

[73] Assignee: Flow International Corporation, Kent, Wash.

[21] Appl. No.: 987,460

[22] Filed: Dec. 8, 1992

[51] Int. Cl.[6] ..... E21C 25/60; B05B 1/04

[52] U.S. Cl. ..... 299/17; 83/177; 239/589; 239/601; 299/81; 451/102

[58] Field of Search ..... 175/67, 424; 299/17, 299/81; 239/589, 596, 599, 600, 601; 83/177, 53; 51/439

[56] References Cited

U.S. PATENT DOCUMENTS

| | | | |
|---|---|---|---|
| 2,618,989 | 11/1952 | Cupler | 76/107 |
| 3,168,848 | 2/1965 | Bardenhagen et al. | 83/174 |
| 3,540,166 | 11/1970 | Crumley | 51/247 |
| 3,709,436 | 1/1973 | Foster | 239/287 |
| 3,726,481 | 4/1973 | Foster et al. | 239/175 X |
| 3,756,106 | 9/1973 | Chadwick et al. | 83/177 |
| 3,897,002 | 7/1975 | Witty | 239/288 |
| 3,960,407 | 6/1976 | Noren | 175/424 X |
| 3,997,111 | 12/1976 | Thomas et al. | 239/1 |
| 4,097,000 | 6/1978 | Derr | 239/601 X |
| 4,111,490 | 9/1978 | Liesveld | 299/17 |
| 4,150,794 | 4/1979 | Higgins | 239/596 |
| 4,216,906 | 8/1980 | Olsen et al. | 239/11 |
| 4,508,577 | 4/1985 | Conn et al. | 134/1 |
| 4,537,639 | 8/1985 | Shook | 134/10 |
| 5,116,425 | 5/1992 | Ruef | 134/17 |
| 5,167,721 | 12/1992 | McComas et al. | 134/32 |

FOREIGN PATENT DOCUMENTS

| | | | |
|---|---|---|---|
| 989083 | 9/1951 | France | 239/597 |
| 2736314 | 2/1979 | Germany . | |

OTHER PUBLICATIONS

High Energy Jets Limited Brochure "A Technical Breaktrough in Fan Jets" undated.

WOMA Jet Nozzle, undated.

Prototype of Jet Nozzle sold on Oct. 1, 1991.

Hashish, M., et al., "Abrasive-Waterjet Deep Kerfing of Concrete for Nuclear Facility Decommissioning," *Proceedings of the Third U.S. Water Jet Symposium*, Pittsburgh, Pa., May 1985, pp. 123-144.

Hashish, M., "Deep Kerfing Concepts with Penetrating Abrasive-Waterjet Nozzles," *Proceedings of the Canadian Congress of Applied Mechanics*, Alberta, Canada, 1987.

Hashish, M., et al., "Development of Abrasive-Waterjet Concrete Deep Kerf Tool for Nuclear Facility Decommissioning," *Proceedings of the International Water Jet Symposium*, Water Jet Technology Association, Beijing, China, Sep. 1987.

*Primary Examiner*—David J. Bagnell

*Attorney, Agent, or Firm*—Seed and Berry

[57] ABSTRACT

A method and system for cutting kerfs in rock is shown and described. In one embodiment, a single fan jet is mounted in ultrahigh-pressure tubing. In an alternative embodiment, a manifold in which two fan jets are mounted is coupled to a manifold in which two round jets are mounted, such that the twin fan jets are directed so as to cover the entire width of the kerf and the round jets are directed towards the edges of the kerf to cut out a well defined kerf. In another alternative embodiment, an angled fan nozzle is mounted in ultrahigh-pressure tubing and combined in a system with another angled fan nozzle mounted in ultrahigh-pressure tubing such that the angled fan jets may be directed at opposite walls of a kerf to carve out a well defined kerf of a desired depth.

17 Claims, 8 Drawing Sheets

DEEP KERFING IN ROCKS WITH ULTRAHIGH-PRESSURE FAN JETS

TECHNICAL FIELD

This invention relates to deep kerfing in rocks, and more particularly, to a method and system for kerfing using ultrahigh-pressure fluid jets.

BACKGROUND OF THE INVENTION

In several situations it is necessary to cut a narrow deep channel, or kerf, for example, when cutting rocks in granite, marble and other rock quarries. Kerfing may also be used in cutting rock tunnels for highways and in mining, among other applications.

The current method of deep kerfing in rocks has been to use either rotating or oscillating water jets. In order for a water jet to cut rock, the stagnation pressure of the water jet must exceed the threshold pressure of the rock, a concept that has been well documented in literature regarding water jets. As an example, granite can have a high threshold pressure such that water jets having pressures of 35,000 psi and beyond are needed to cut the rock. Current systems reaching these pressures typically have round jets with a diameter on the order of 0.01 to 0.080 inch. While the nozzle that holds such jets is typically much larger than the jet diameter, the width of the kerf that is cut closely corresponds to the jet diameter. This creates several problems. In order to cut a kerf to a given depth, it is necessary to move the nozzle closer to the bottom of the kerf to maintain a strong jet. However, because the nozzle is wider than the kerf that is normally formed by a jet, it is necessary to make the kerf wider than the nozzle.

In order to make the kerf wider than the nozzle, current systems typically use a rotating or oscillating water jet system. However, these systems have many disadvantages. For example, a rotating water jet system is mechanically complex and bulky in that it requires an ultrahigh pressure swivel for conveying water to a rotating stem and nozzle, and a drive system that can overcome the torque of the swivel at high pressures and rotate the stem leading to the nozzle at a required RPM. Such a system typically requires hydraulics which in turn requires pressure and return line hoses, which further complicate the system. As an example, when cutting a rock tunnel it is impossible to place the jet nozzle at a true boundary of the tunnel due to the bulkiness of current systems. It is therefore necessary to cut outwards and excavate a larger tunnel than desired so that as the tunnel is cut in steps, the nozzle can be placed at a true, desired boundary. Such a process is both time and cost ineffective.

Although an oscillating water jet system is somewhat more simple than a rotating water jet system, in that it does not require a swivel, it must still be able to convey water from a fixed conduit to a moving conduit. As a result, various fatigue problems are encountered. In addition, a drive system is still required to oscillate the assembly.

A need therefore exists for a simplified system that can cut deep kerfs in rocks while avoiding the numerous problems discussed above.

SUMMARY OF THE INVENTION

It is therefore an object of this invention to provide an improved method of deep kerfing in rocks.

It is another object of this invention to provide a system for kerfing in rocks that is mechanically reliable and simple.

It is another object of this invention to provide a system that can cut deep kerfs in rocks while avoiding problems of funnelling.

These and other objects of the invention, as will be apparent as preferred embodiments are described more fully herein, are accomplished by providing a method/-system using an ultrahigh-pressure fan jet nozzle that produces an ultrahigh-pressure fluid fan jet. In a preferred embodiment, pressurized fluid, typically water, is generated by high-pressure, positive displacement pumps or other suitable means. Such pumps pressurize a fluid by having a reciprocating plunger that draws the fluid from an inlet area into a pressurization chamber during an intake stroke, and acts against the fluid during a pumping stroke, thereby forcing pressurized fluid to pass from the pressurization chamber into an outlet chamber, from which it is collected into a manifold. The pressurized fluid is then directed through the nozzle of a tool thereby creating an ultrahigh-pressure jet that may be used to perform a particular task, for example, deep kerfing in rocks. Such jets may reach pressures up to and beyond 55,000 psi.

In a preferred embodiment, the nozzle has an inner surface defined by a conical bore that extends from a first end of the nozzle to a second end of the nozzle. As a result, the first end is provided with an entrance orifice through which a volume of pressurized fluid may enter the nozzle and the second end is provided with an exit orifice through which the pressurized fluid may exit after passing through the body of the nozzle. The second end of the nozzle is further provided with a wedge-shaped notch that extends from its widest point at the second end in towards the first end of the nozzle, intersecting the exit orifice. As a result, the shape of the exit orifice is defined by the intersection of the conical bore and the wedge-shaped notch. The shape of the exit orifice causes the pressurized fluid leaving the nozzle to do so as a fan jet, having a substantially linear footprint, the width of which varies with changes in the geometry of the nozzle. For purposes of discussion, the footprint may be viewed as a thin rectangle, or as an oval having a very high aspect ratio, such as 100 to 1, having a major axis and a minor axis.

In one embodiment of the present invention, a single fan jet nozzle is mounted in ultrahigh pressure tubing having a diameter of $\frac{3}{8}$ inch, such that the diameter of the entire assembly does not exceed $\frac{3}{8}$ inch. By placing the nozzle at a standoff distance of 0.25 to 0.375 inch, wherein the standoff is the distance between the exit orifice and the bottom of the kerf, the fan jet will produce a kerf having a width of approximately 0.5 to 0.6 inch. Given that the kerf is wider than the nozzle assembly, the nozzle may be fed directly into the kerf. In such a system, the feed rate must be appropriately controlled because if the feed rate is too fast, funnelling of the kerf may occur and if the feed rate is too slow, the standoff will increase to a point where the fan jet becomes less effective, due to a loss of integrity and power.

In an alternative embodiment illustrated herein, a wider kerf is achieved by mounting two fan jet nozzles in a manifold such that the two fans are angled outwards relative to a vertical axis. The two fan jets are parallel to each other but are positioned at an angle relative to a imaginary line joining their centers, to avoid interfering with each other. In order to further ensure that funnelling does not occur, this system may be expanded by adding a second manifold in which two round jets are mounted at an angle relative to a vertical axis, wherein the included angle between the two round jets is larger than the included angle of the two fan jets, such that the round jets are directed at the walls of the kerf thereby encouraging good wall definition.

The power distribution of the fan jet may be controlled by changing an internal angle of the conical bore and an angle of the wedge-shaped notch. This is beneficial because different power distributions may be more appropriate than others for a particular task. For example, in the context of kerfing as discussed above, it is believed to be desirable to have a fan jet with a power distribution that is concentrated at the ends of the fan jet, which may be accomplished by correctly adjusting the geometry of the nozzle. In alternative embodiments, a fan jet having such a power distribution may be mounted in a single or twin manifold as described above, whereby more power is directed to the edges of the kerf than the center to further minimize the problem of funnelling, wherein the side walls of the kerf absorb energy from the jet, resulting in the kerf becoming narrower.

In a preferred embodiment, an outer surface of the nozzle is also conical such that the second end has a substantially circular, planar surface. In addition, the wedge-shaped notch is aligned with a diameter of the circular planar surface such that the resulting fan jet will be vertically aligned with a longitudinal axis of the nozzle. In an alternative embodiment, the wedge-shaped notch may be offset such that it is not aligned with a diameter of the surface of the second end, thereby producing a "side-firing" fan jet that exits the nozzle at an angle relative to the longitudinal axis of the nozzle. Such a side-firing jet may also be produced by grinding the wedge-shaped notch at an angle relative to the longitudinal axis of the nozzle, such that the axis of the nozzle is not in the plane of the notch.

In a yet another alternative embodiment, the wedge-shaped notch may be at an angle relative to the longitudinal axis of the nozzle such that the axis of the nozzle is in the plane of the notch. This produces an "angled" fan jet. By mounting an angled fan jet nozzle in ultrahigh pressure tubing, it is possible to direct the power of the fan jet against the wall of the kerf without having to change the axis along which the nozzle is mounted. This therefore eliminates the need for a manifold, thereby increasing the simplicity of the system and decreasing cost.

The various embodiments discussed above may be encased in steel tubing to protect the nozzle assemblies from the harsh environments where they may be exposed to abrasion and impact. In addition, a wear plate may be used at the end of the nozzle assemblies that are being fed into the kerf, whereby the assembly may be pressed against the bottom of the kerf without damaging the nozzle.

In a preferred embodiment illustrated herein, the nozzle is mounted in a receiving cone such that when a volume of pressurized fluid passes through the nozzle, the receiving cone acts against the nozzle causing the inner walls of the nozzle near and at the exit orifice to be in a compressive state of stress. This condition increases the nozzle's resistance to fatigue and wear.

A nozzle in accordance with a preferred embodiment illustrated herein is manufactured by machining out a conical bore from a blank of annealed stainless steel. The internal surface of the nozzle is finished by pressing a cone-shaped die into the conical bore, thereby eliminating machining marks and improving the inner surface quality. The part is then heat treated, before or after which the outer surface of the nozzle may be finished. Once the part is heat treated, a wedge-shaped notch is machined out of the second end of the nozzle to a sufficient depth such that a shape of the exit orifice is defined by the intersection of the conical bore and the wedge-shaped notch.

DETAILED DESCRIPTION OF THE INVENTION

In various contexts, for example, cutting rocks in quarries, it is necessary to cut deep trenches, or kerfs. When kerfing in rock, a common problem that is encountered is a phenomenon called funnelling wherein the walls of a kerf absorb power from the fan jet such that the kerf becomes narrower and narrower until the tool becomes stuck. Avoiding such problems and cutting deep kerfs is accomplished in several embodiments of the current invention using a method and system employing ultrahigh-pressure fluid fan jets.

Ultrahigh-pressure fluid jets in general may be generated by high-pressure, positive displacement pumps (not shown) and may reach pressures up to and beyond 55,000 psi. The pressurized fluid generated by the pump is typically collected in a manifold from which the fluid is directed through the nozzle of a tool (not shown), thereby creating an ultrahigh-pressured jet that may be used to perform a particular task.

In the current state of the art, kerfing is accomplished by using either rotating or oscillating water jets. These methods and systems have limitations, however, in that they are mechanically complex and cumbersome and do not always provide consistent and acceptable results. Such systems are also subject to wear and fatigue, given the need for elements such as a swivel and hydraulic drive mechanism.

Figure 1:
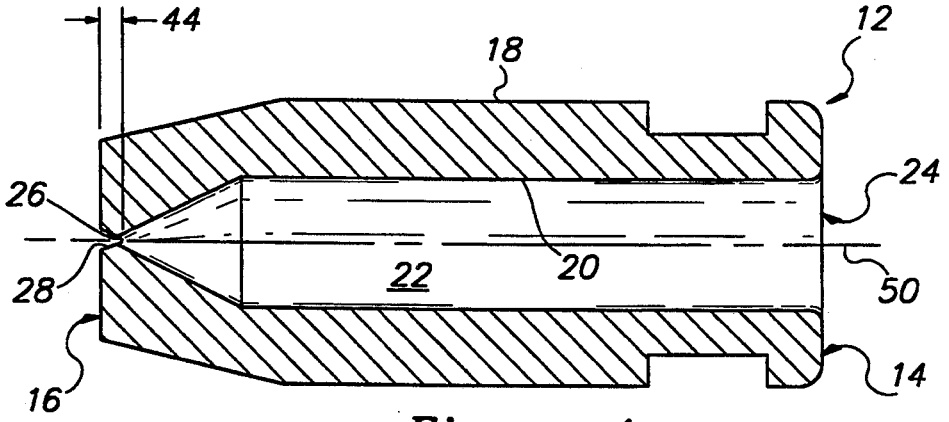
FIG. 1 is a cross-sectional view of a nozzle illustrating an element of a preferred embodiment of the present invention.
Figure 2:
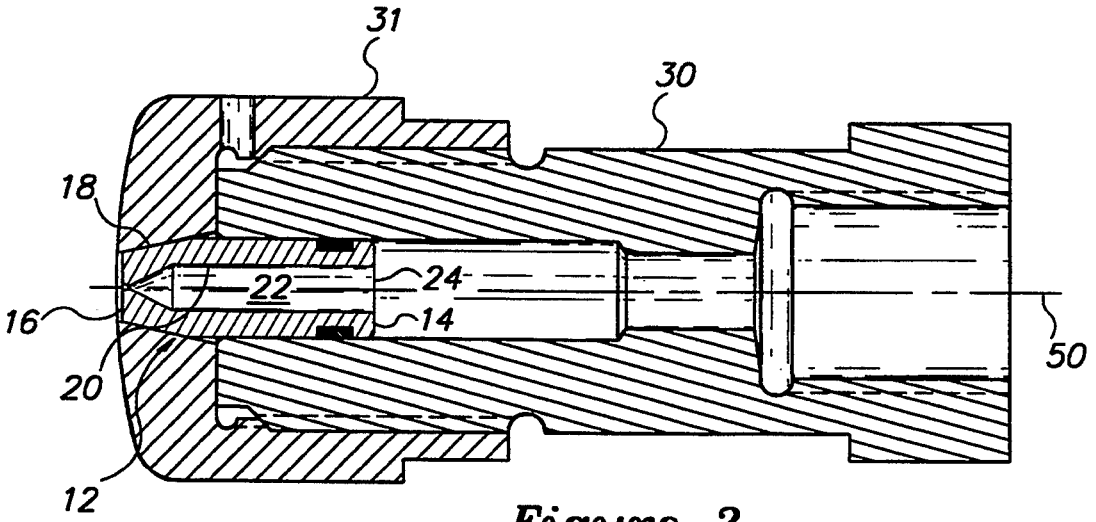
FIG. 2 is a cross-sectional view of the nozzle of FIG. 1 mounted in a receiving cone.

FIGS. 1 and 2 illustrate a nozzle 12 used in preferred embodiments of the present invention. The nozzle 12 has a first end 14, a second end 16, an outer surface 18 and an inner surface 20. The inner surface 20 is defined by a conical bore 22, that extends from the first end 14 to the second end 16, thereby creating an entrance orifice 24 and an exit orifice 26 in the first end 14 and second end 16, respectively. A wedge-shaped notch 28 extends from the second end 16 in towards the first end 14 to a depth 44 such that the notch 28 and conical bore 22 intersect. The shape of the exit orifice 26 is therefore defined by this intersection of the conical bore 22 and the wedge-shaped notch 28. As a volume of pressurized fluid passes through the nozzle 12 and out the exit orifice 26, the shape of the exit orifice 26 causes the pressurized fluid to exit the nozzle as a fan jet, having a substantially linear footprint.

As illustrated in FIG. 2, the nozzle 12 in a preferred embodiment is mounted within a receiving cone 30, including a nozzle nut 31. As pressurized fluid passes through the receiving cone 30 and the nozzle 12, the receiving cone 30 acts against the nozzle 12 thereby placing the inner surface 20 of the nozzle 12 near and at the exit orifice 26 in a compressive state of stress. By being in compression rather than tension, the nozzle 12 is more resistant to fatigue and wear.

Figure 9A:
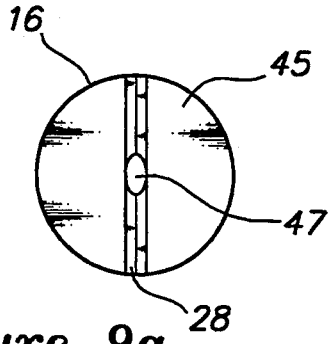
FIGS. 9*a–b* are bottom plan views illustrating alternative embodiments of the nozzle of FIG. 1.
Figure 10A:
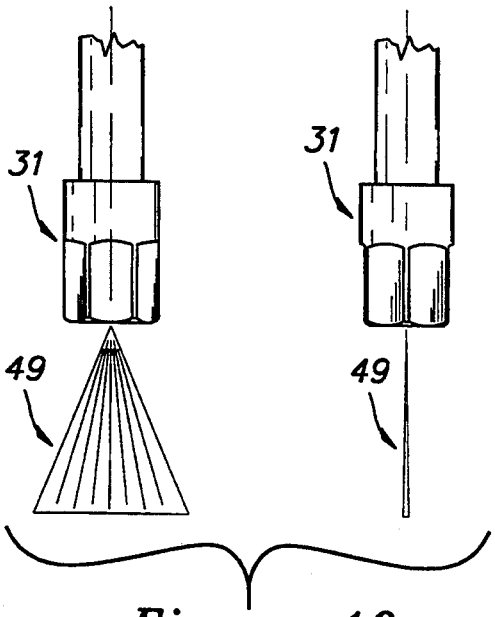
FIGS. 10*a–c* are diagrams illustrating front and side views of three alternative embodiments of the nozzle of FIG. 1 and resulting fan jets.

In a preferred embodiment, the outer surface 18 of the nozzle 12 is conical such that the second end 16 has a substantially circular, planar surface 45, as illustrated in FIG. 9a. The wedge-shaped notch 28 is aligned along a diameter of the circular surface 45, such that it passes through a center 47 of the second end 16. As a result, the fan jet of pressurized fluid will exit the nozzle 12 in a direction substantially aligned with a longitudinal axis 50 of the nozzle 12. This fan jet may be referred to as a "straight" fan 49, as illustrated in FIG. 10*a*. A straight fan 49 may be useful in various contexts, for example, in kerfing in rocks, as will be discussed in greater detail below.

Figure 9B:
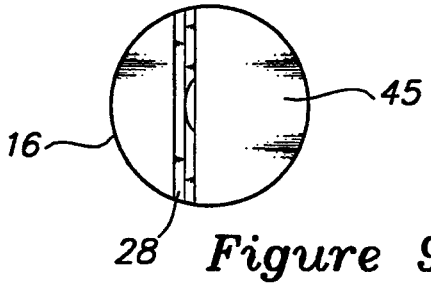
Figure 10B:
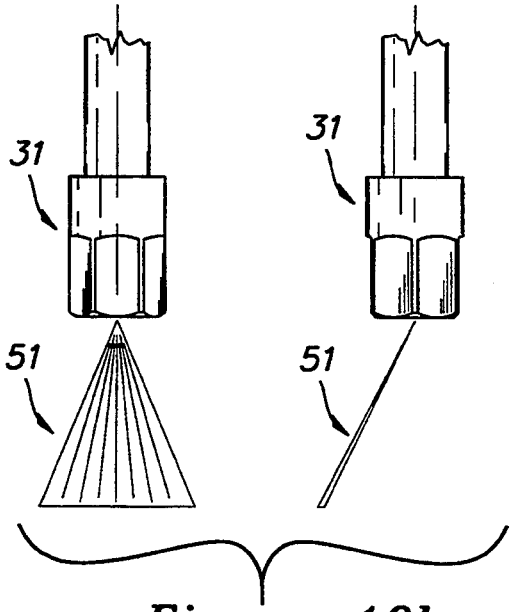

In an alternative embodiment, as illustrated in FIG. 9*b*, the wedge-shaped notch 28 is offset such that it is not aligned along a diameter of the circular surface 45 of the second end 16. As a result, the fan jet will exit the nozzle 12 at an angle relative to the longitudinal axis 50 of the nozzle 12. Such a fan jet may be referred to as a "side-firing" fan 51, as illustrated in FIG. 10*b*. A side-firing fan jet 51 may also be produced by grinding the wedge-shaped notch 28 at an angle relative to the longitudinal axis 50 of nozzle 12, such that the axis 50 of nozzle 12 is not in the plane of the notch 28. Side-firing fan jets 51 may be useful in various contexts, for example, when it is necessary to clean or remove grout from sides of a narrow, deep area, such as a gap between two concrete blocks.

Figure 10C:
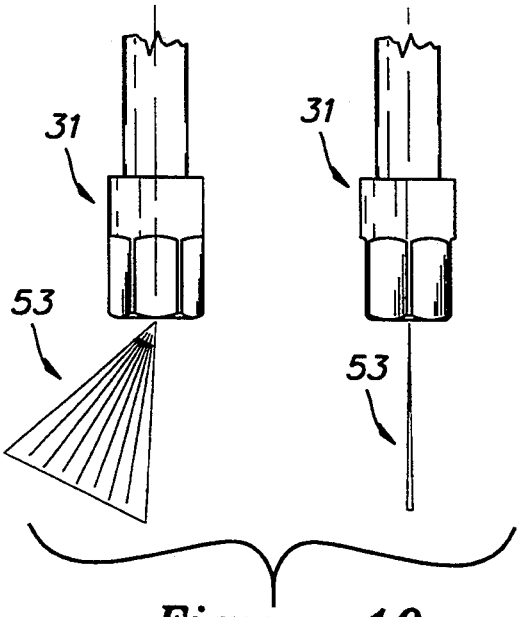

In yet another alternative embodiment, as illustrated in FIG. 10*c* the wedge-shaped notch 28 may be at an angle relative to the longitudinal axis 50 of the nozzle 12 such that the axis 50 of the nozzle 12 is in the plane of the notch 28. This produces an "angled" fan jet 53, which is believed to be useful in various contexts, including kerfing.

As discussed above, the pressurized fluid exiting the nozzle 12 is in the form of a fan jet having a substantially linear footprint, the width of which varies with changes in the geometry of the nozzle. For purposes of discussion, the footprint may be viewed as a thin rectangle, or as an oval having a very high aspect ratio, such as 100 to 1, having a major axis and a minor axis. The geometry of the fan jet may be controlled by adjusting the geometry of the nozzle, different geometries being more desirable depending on the task at hand.

Figure 7A:
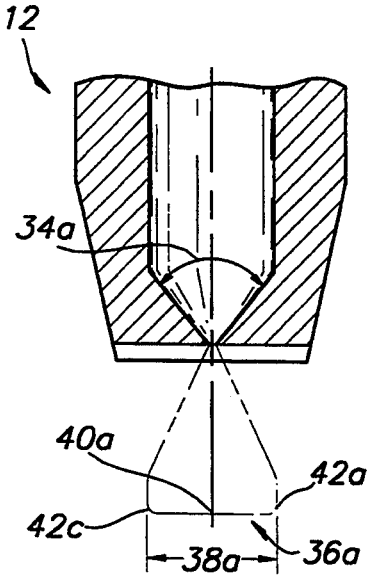
FIGS. 7*a–c* are diagrams illustrating the effect of changing an internal cone angle of the nozzle of FIG. 1 on the power distribution of a resulting fan jet.
Figure 7B:
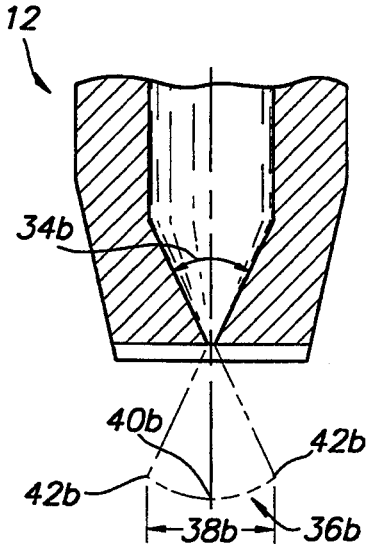
Figure 7C:
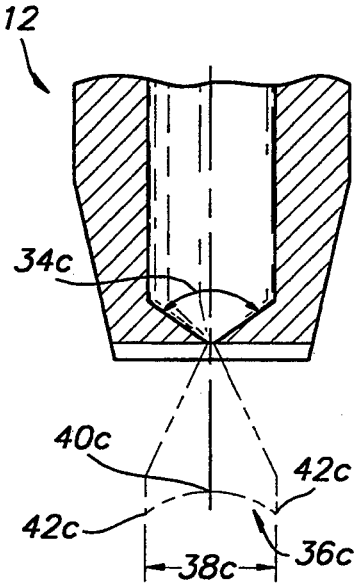

As illustrated in FIGS. 10*a–c*, the geometry of the nozzle 12 may be altered to control the resulting geometry and power distribution of the fan jet. For example, in kerfing, it is believed to be desirable to have a power distribution that is concentrated at the ends of a fan jet thereby resulting in additional power being directed at walls so a kerf 76. In one embodiment of the present invention, as illustrated in FIG. 7*a*, an internal angle 34*a* of the conical bore 22 is 90° to achieve a uniform power distribution 36*a* of the fan jet, such that the power at the center 40*a* at the ends 42*a* of the fan jet is the same. In an alternative embodiment, as illustrated in FIG. 7*b*, the internal angle 34*b* of the conical bore 22 is less than 90°, for example, 60°, thereby resulting in a power distribution 36*b* that is concentrated at a center 40*b* of the fan jet and tapers at the ends 42*b* of the fan jet. In another alternative embodiment, as illustrated in FIG. 7*c*, an internal angle 34*c* of the conical bore 22 is greater than 90°, for example, 105°, resulting in a power distribution 36*c* that is concentrated on the ends 42*c* of the fan jet and minimal at the center 40*c* of the fan jet.

Figure 5C:
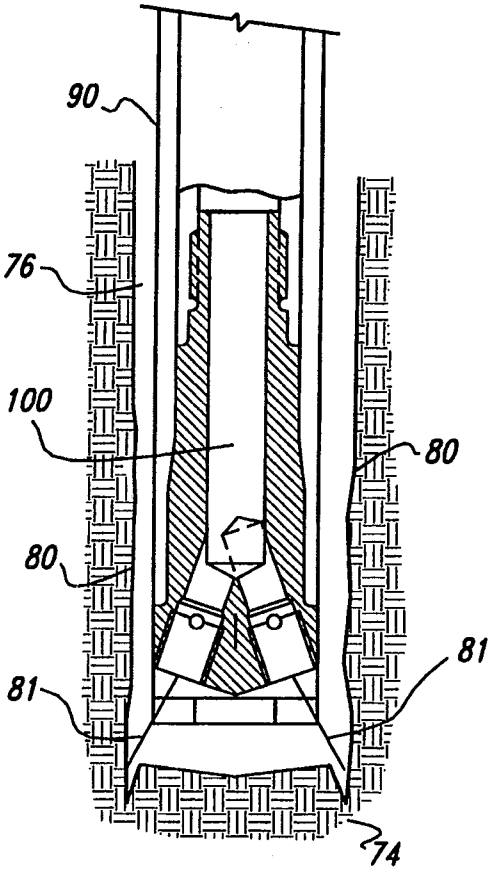
FIGS. 5*b–c* are front elevational views of elements of the assembly of FIG. 5*a*.
Figure 8A:
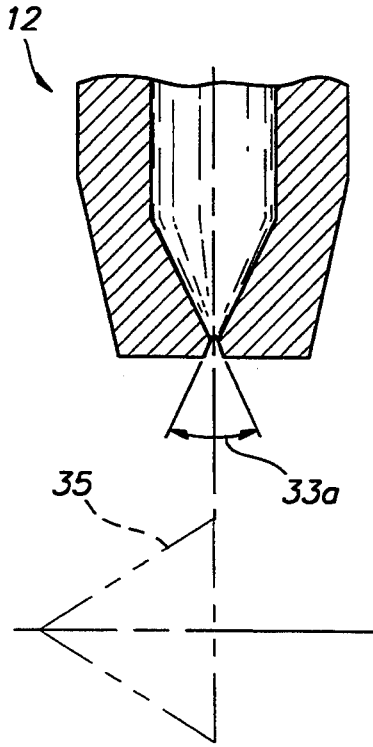
FIGS. 8*a–c* are diagrams illustrating the effect of changing an external wedge angle of the nozzle of FIG. 1 on the shape of the resulting fan jet.
Figure 8B:
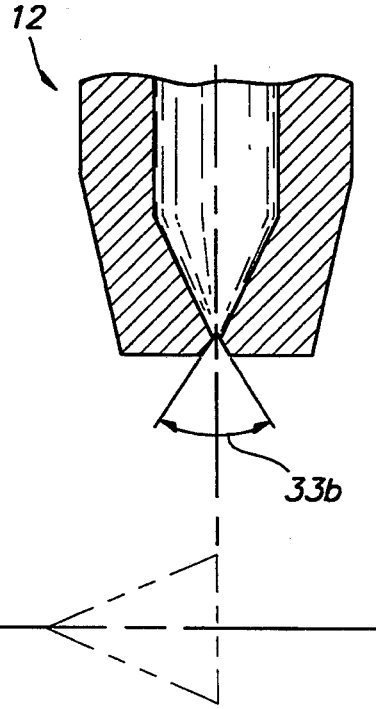
Figure 8C:
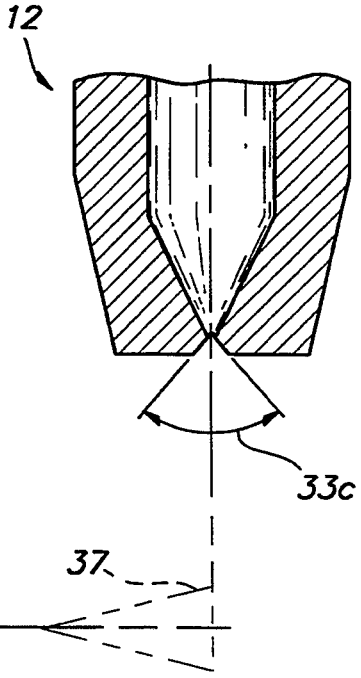

As illustrated in FIGS. 8*a–c*, changes to an external angle 33 of the wedge-shaped notch 28 may be made to control the shape and thickness of the fan jet. As illustrated in FIG. 8*a*, a small wedge angle 33*a* produces a wide-angled fan 35, while a large wedge angle 33*c*, as shown in FIG. 5*c*, produces a narrow-angled fan 37. Although not shown, the thickness of the fan jet also increases with an increase in the wedge angle. Again, different configurations have different applications, for example, a narrow-angled fan such as that produced by the wide-angled wedge angle in FIG. 8*c* will be more focused in delivering power to a target, which may be necessary if the distance between the nozzle 12 and the surface being acted upon is great.

Figure 3A:
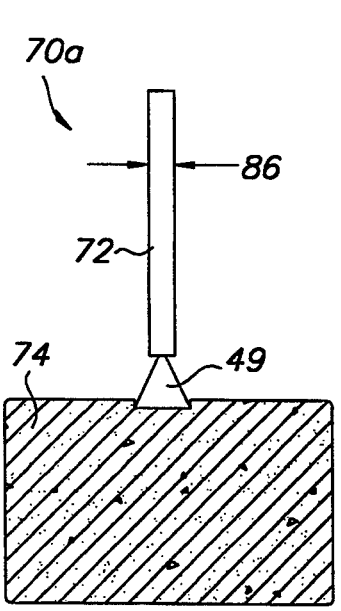
FIGS. 3*a–c* illustrate a kerf being cut in accordance with three alternative embodiments of the present invention.
Figure 3B:
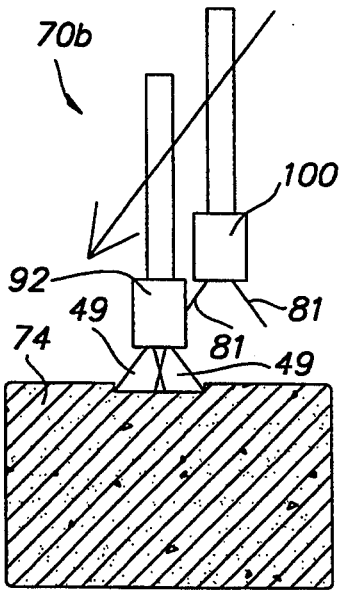

As illustrated in FIG. 3*a*, one embodiment of the present invention, which may be referred to as a single fan kerfing assembly 70*a*, mounts a fan jet nozzle 12 machined to produce a straight fan jet 49 in ultrahigh-pressure tubing 72. Different diameter of tubing may be used; however, in a preferred embodiment, tubing having a diameter 86 of ⅜ inch is used. By using such a system, the diameter of the assembly 78 is no greater than the diameter 86 of the tubing 72. In a preferred embodiment, the standoff 84, which may be defined as the distance between the exit orifice 26 of the nozzle 12 and the bottom surface 83 of the kerf 76, is maintained at between 0.25 and 0.375 inch. At a standoff in this range, a kerf 76 may be cut having a width 78 of approximately 0.5 to 0.6 inch. Given that the width 78 of the kerf 76 is greater than the diameter 86 of the tubing 72, it is possible to feed the assembly 78 into the kerf to achieve a desired depth. Care must be taken, however, to ensure that the feed-in rate is not too high, which can result in funnelling. In an alternative embodiment, a fan jet having a power distribution 36*c* that is concentrated at the ends, as illustrated in FIG. 7*c*, may be used to direct extra power to the walls 80 of a kerf 76 thereby reducing the problem of funnelling.

Figure 5B:
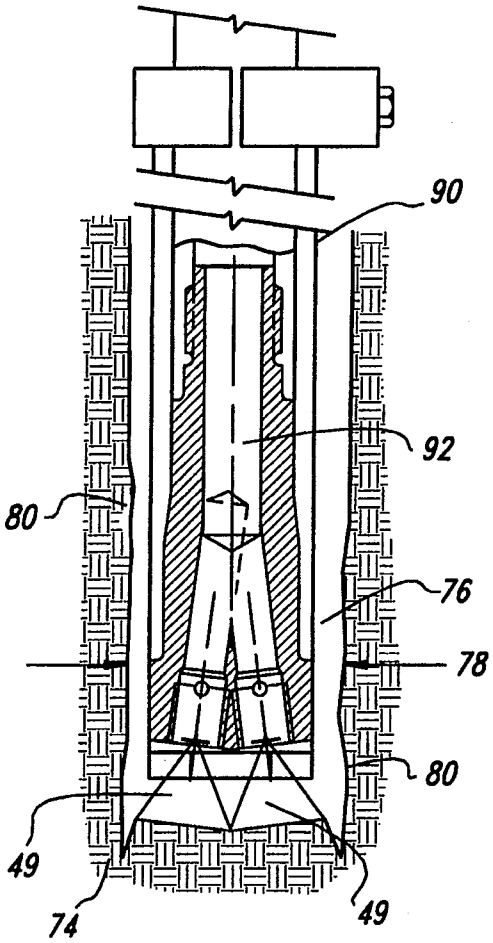
Figure 5A:
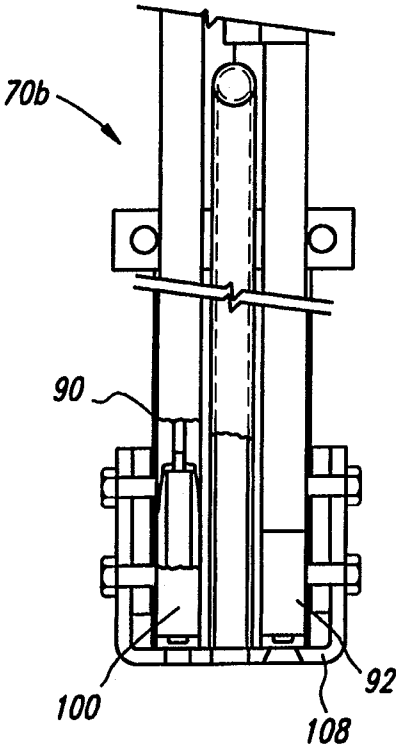
FIG. 5*a* is a side elevational view of a kerfing assembly illustrating an embodiment off the present invention.

An alternative embodiment is illustrated in FIGS. 3*b*, 4*a*–4*b*, 5*a*–*c* and 6. In this embodiment, a first manifold 92 mounts two fan jet nozzles at an angle relative to a vertical axis 94. The two fan jet nozzles generate straight fan jets 49 that are parallel to each other, but are not coplanar, to avoid interference. In a preferred embodiment, the fan jets 49 create an included angle 96 between the centerlines 98 of the fan jets 49. In a preferred embodiment, this included angle is 14°. As illustrated in FIG. 5*b*, the fan jets 49 carve out a kerf 76 having a width 78. As illustrated in FIG. 5*a*, the first manifold 92 is coupled with a second manifold 100 which mounts two nozzles that produce round jets 81. Round jets are known in the art, and any acceptable nozzle known to one of ordinary skill in the art may be used. The round jet nozzles are mounted at an angle relative to a vertical axis 104, such that the round fan jets 81 create an included angle 106 between them. In the preferred embodiment illustrated herein, this included angle is 38°. As illustrated in FIG. 5*c*, the round jets 81 are directed at the walls 80 of the kerf 76 thereby serving to define the walls 80 and minimize the problem of funnelling. As illustrated in FIG. 5*a*, the first and second manifolds 92 and 100 may be laterally aligned and spaced such that they work in unison to define and cut a keff 76.

In an alternative embodiment, end-powered fan jets as illustrated in FIG. 7*c* may be used in place of the straight fan jets 49 in the first manifold 92. This will further serve to direct power to the walls 80 of the kerf 76 to avoid funnelling. Funnelling may also be minimized by controlling the teed rate to maintain a desired standoff 84.

Figure 3C:
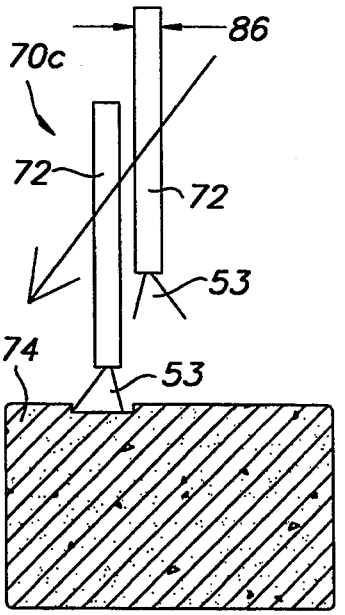
Figure 4A:
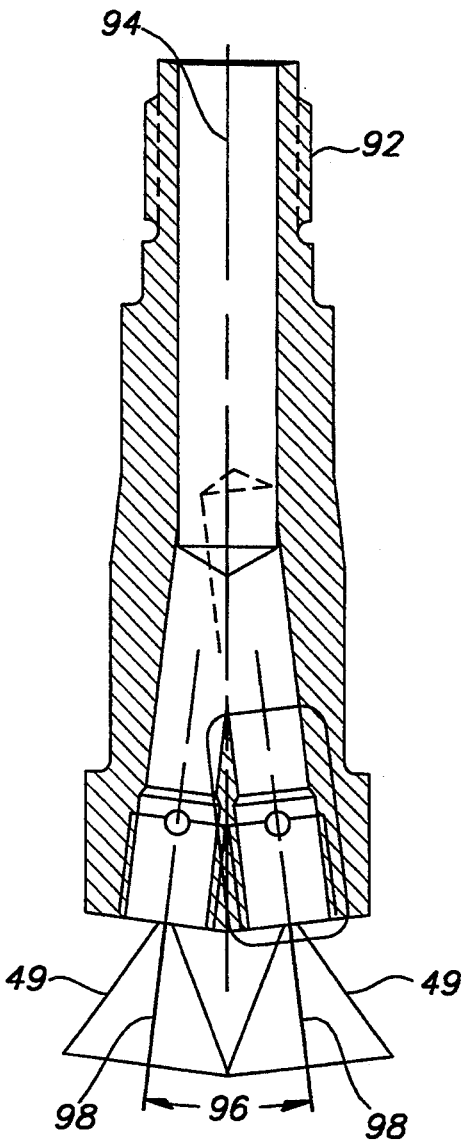
FIGS. 4*a* and 4*b* are cross-sectional views of manifolds used in alterative embodiments of the present invention.
Figure 4B:
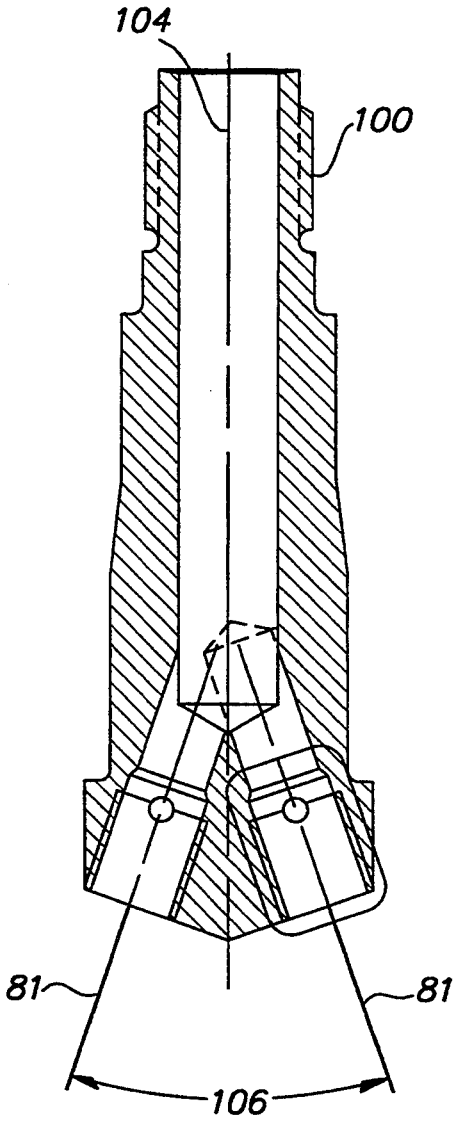
Figure 11:
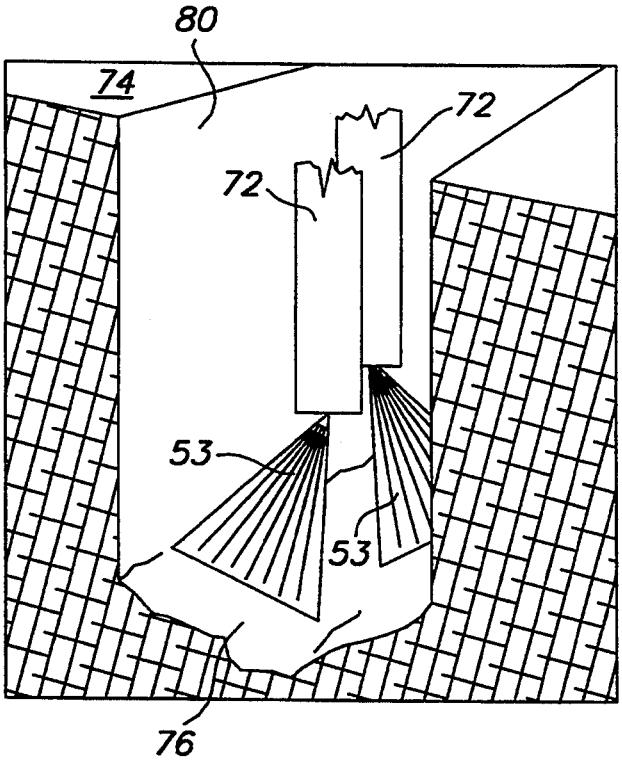
FIG. 11 is a diagram illustrating a kerf being cut in accordance with an embodiment of the present invention.

An alterative embodiment is illustrated in FIGS. 3*c* and 11, and uses angled fan jets 53 as illustrated in FIG. 10*c*. Because the angled fan jet 53 exits the nozzle at an angle relative to a vertical axis of the nozzle, it is possible to extend the lateral reach of the fan jet 53 without having to mount the nozzle at an angle relative to a vertical axis. Such a nozzle may therefore be mounted in ultrahigh-pressure tubing 72, similar to the embodiment illustrated in the FIG. 3*a*, thereby eliminating the need for manifold. By using two angled fan jets 53 in ultrahigh-pressure tubing 72, as illustrated in FIG. 3*c* and 11, it is possible to direct the angled jets 53 to opposite walls 80 of a kerf 76.

Figure 6:
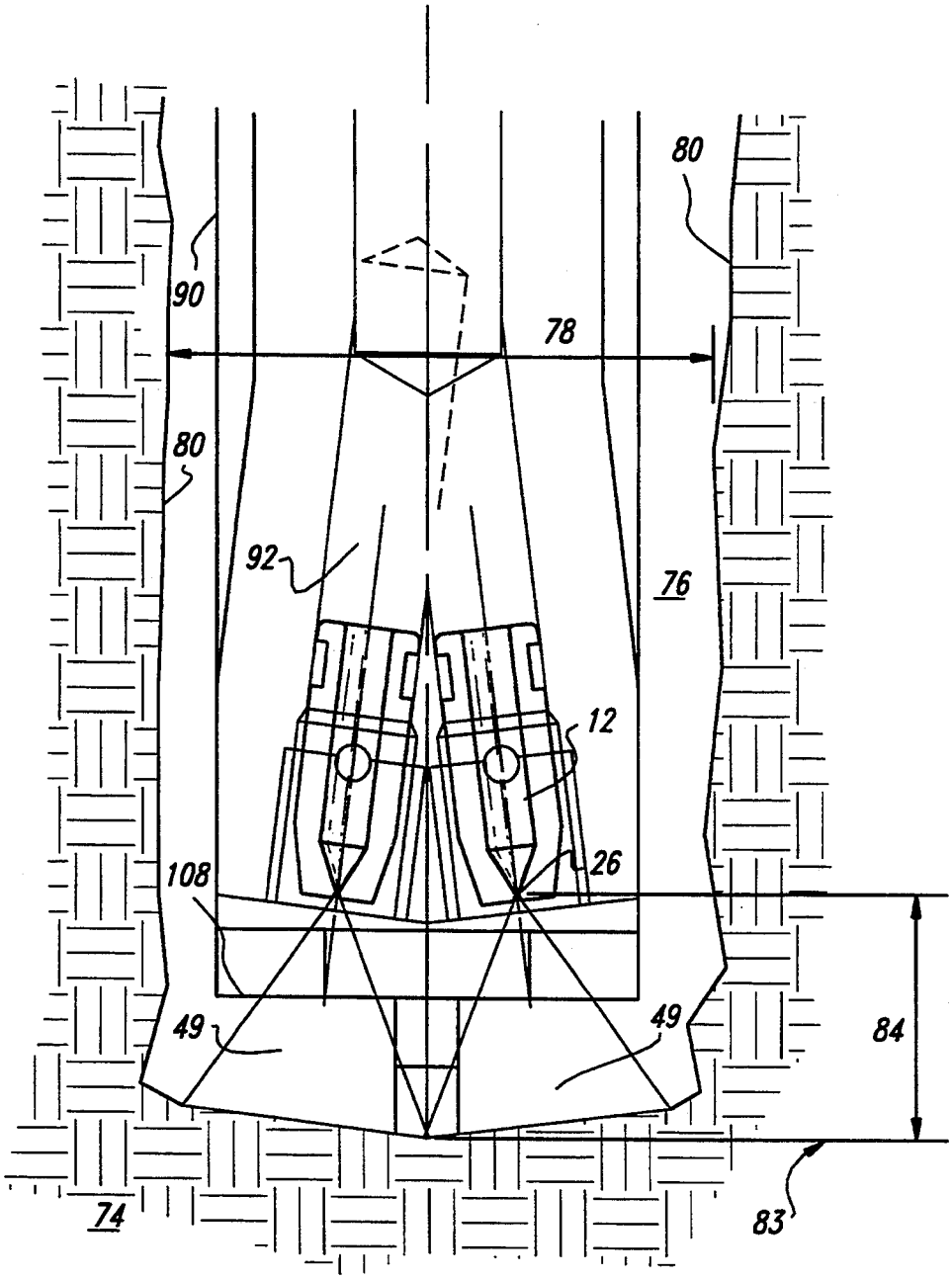
FIG. 6 is a diagram illustrating a kerf being cut in accordance with an embodiment of the present invention.

Given the harsh environments in which these various embodiments will operate, for example in quarries or in a mining environment, it is beneficial to protect the kerfing assemblies. In alternative embodiments, the assemblies are encased in a hard, protective tubing, for example, steel, in order to protect the ultrahigh-pressure tubing 72 and nozzles from abrasion and impact. In addition, a wear plate 108 as illustrated in FIGS. 5*a* and 6 may be coupled to the manifolds 92 and 100 to further protect the nozzles from scraping against rock 74.

The fan jet nozzle 12 employed in the preferred embodiments illustrated herein is manufactured by machining a blank 64 from any high-strength, metallic alloy, for example, annealed steel. In a preferred embodiment, the nozzle 12 is made from Carpenter Custom 455 stainless steel. The conical bore 22 is machined out of the blank, after which the inner surface 20 is finished by pressing a cone-shaped die (not shown) into the conical bore 22, thereby eliminating machining marks and improving the quality of the inner surface 20. The nozzle 12 is then heat treated at a given temperature for a given amount of time, to increase the strength of the material. The correct temperature and time are dependent on the material used, and will be known by one of ordinary skill in the art. For example, in a preferred embodiment, where the nozzle is made from Carpenter Custom 455, the nozzle is treated at 900° F. for four hours, and then air cooled. The outer surface 18 of the nozzle 12 may be finished before or after the nozzle is heat treated. In a preferred embodiment, the outer surface 18 is conical, such that the second end 16 has a substantially circular, planar surface 45.

Figure 12:
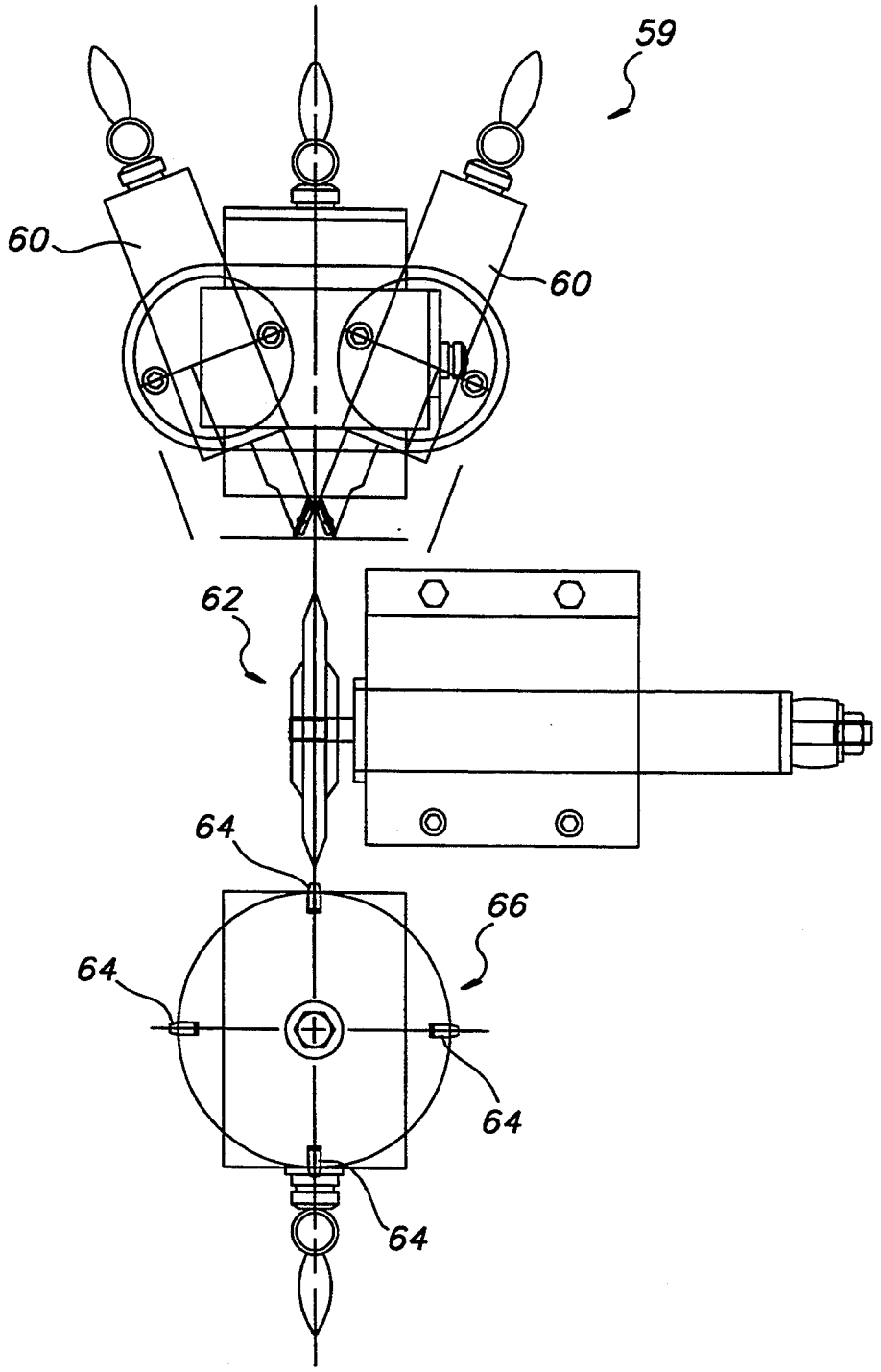
FIG. 12 is a top plan view of a grinding fixture used to manufacture the nozzle of FIG. 1.

The wedge-shaped notch 28 is then machined into the second end 16 of the blank 64, or nozzle 12, to a sufficient depth such that the notch 28 intersects the exit orifice 26 created by the conical bore 22. As illustrated in FIG. 12, the grinding fixture 59 includes two diamond dressers 60 which may be positioned to create a desired angle such that when the dressers 60 act against a grinding wheel 62, they will produce the same angle on the edge of the grinding wheel 62. Several of the blanks 64 are mounted on a turret 66, which may move both laterally and longitudinally to align the blank 64 with the grinding wheel 62. As the grinding wheel 62 acts against the blank 64 to create the wedge-shaped notch 28, the angle of which corresponds to the desired angle of the dressers and grinding wheel, lubricants are used to cool the machinery and prevent damage, the method and necessity of which will be understood by one of ordinary skill in the art.

A first blank 64 is used to calibrate the system. An operator of the grinding fixture 59 grinds a wedge-shaped notch 28 into the blank 64, and then rotates the turret 66 90° to inspect the alignment of the wedge-shaped notch 28 with the conical bore 22. This inspection is done through a microscope (not shown). If the wedge-shaped notch 28 is not properly aligned, adjustments are made by moving the turret 66. Once the desired alignment is achieved, multiple nozzles 12 may then be completed very quickly by mounting multiple blanks 64 on the turret 66 and grinding the wedge-shaped notch 28 via the grinding wheel 62. In addition, different depths of the wedge-shaped notch 28 will be desired, depending on the intended task and the size of the nozzle, as measured by a diameter of the nozzle 12. The desired depth is calibrated and checked by measuring the length of a minor axis of the exit orifice 26 which will have an oval shape due to the intersection of the wedge-shaped notch 28 and the conical bore 22.

A method and system for kerfing in rocks using ultrahigh-pressure fluid fan jets has been shown and described. From the foregoing, it will be appreciated that, although embodiments of the invention have been described herein for purposes of illustration, various modifications may be made without deviating from the spirit and scope of the invention. For example, the manifold 92 which mounts twin fan jets 49 may be used alone or in connection with manifold 100, as described. In addition, end-powered fan jets as illustrated in FIG. 7*c* may be used in the various embodiments to direct power to the walls 80 of a kerf 76 to further avoid the problem of funnelling. The rate at which the different assemblies shown and described are fed into a kerf 76 may also be controlled to maintain a desired standoff distance that will ensure sufficient power is directed to cutting the kerf. Similarly, those skilled in the art will recognize that the methods and apparatus described herein may be useful for certain non-kerfing tasks and for cutting material other than rocks, for example, concrete. Thus, the present invention is not limited to the embodiments described herein, but rather is defined by the claims which follow.

I claim:

1. An assembly for kerfing comprising:

an ultrahigh-pressure fan jet nozzle having a first end, a second end, an outer surface and an inner surface, the inner surface being defined by a conical bore extending through the nozzle from the first end to the second end such that the first end is provided with an entrance orifice and the second end is provided with an exit orifice and a volume of pressurized fluid may pass through the entrance orifice, through the nozzle and out the exit orifice to perform a task and wherein a wedge-shaped notch extends from the second end in towards the first end such that a shape of the exit orifice is defined by the intersection of the conical bore and the wedge-shaped notch such that the exit orifice causes the pressurized fluid to exit the nozzle as a fan jet; and ultrahigh-pressure tubing coupled to the fan jet nozzle to provide a conduit for the pressurized fluid such that a diameter of the assembly does not exceed a diameter of the tubing.

2. The assembly according to claim 1 wherein an internal angle of the conical bore near the exit orifice is greater than 90° such that a power distribution of the fan jet is concentrated at an end of the fan jet and minimal near a center of the fan jet, thereby directing more power towards walls of the kerf.

3. The assembly according to claim 1 wherein the ultrahigh-pressure tubing is encased in a hard, protective tubing thereby stiffening the assembly and protecting the ultrahigh pressure tubing from abrasion and impact.

4. An assembly for kerfing, comprising:

a first manifold adapted to receive two fan jet nozzles, each fan jet nozzle having a first end, a second end, an outer surface and an inner surface, the inner surface being defined by a conical bore extending through the fan jet nozzle from the first end to the second end such that the first end is provided with an entrance orifice and the second end is provided with an exit orifice and a volume of pressurized fluid may pass through the entrance orifice, through the fan jet nozzle and out the exit orifice to perform a task and wherein a wedge-shaped notch extends from the second end in towards the first end such that a shape of the exit orifice is defined by the intersection of the conical bore and the wedge-shaped notch such that the exit orifice causes the pressurized fluid to exit the fan jet nozzle as a fan jet; and wherein the fan jet nozzles are mounted at an angle relative to a vertical axis such that the fan jets generated by the fan jet nozzles are parallel to each other and form a first included angle between centerlines of the fan jets.

5. The assembly according to claim 4 wherein an internal angle of the conical bore of each fan jet nozzle near the exit orifice is greater than 90° such that a power distribution of each fan jet is concentrated at an end of the fan jet and minimal near a center of each fan jet, thereby directing more power towards walls of a kerf.

6. The assembly according to claim 4 wherein the manifold is encased in a hard, protective tubing thereby stiffening the assembly and protecting the nozzles from abrasion and impact.

7. The assembly according to claim 4, further comprising:

a second manifold adapted to receive two round jet nozzles, each of the round jet nozzles being adapted to generate a round jet when a volume of pressurized fluid is passed through the round jet nozzle, the round jet nozzles being mounted at an angle relative to a vertical axis, such that the round jets form a second included angle that is greater than the first included angle to further define walls of a kerf.

8. The assembly according to claim 7 wherein a wear plate is coupled to the first manifold and to the second manifold to protect the fan jet nozzles and the round jet nozzles as the assembly is fed into a kerf.

9. An assembly for kerfing, comprising:

an ultrahigh-pressure angled fan jet nozzle having a a first end, a second end, an outer surface and an inner surface, the inner surface being defined by a conical bore extending through the nozzle from the first end to the second end such that the first end is provided with an entrance orifice and the second end is provided with an exit orifice and a volume of pressurized fluid may pass through the entrance orifice, through the nozzle and out the exit orifice to perform a task and wherein a wedge-shaped notch extends from the second end in towards the first end such that a shape of the exit orifice is defined by the intersection of the conical bore and the wedge-shaped notch such that the exit orifice causes the pressurized fluid to exit the nozzle as a fan jet and wherein the wedge-shaped notch of the fan jet nozzle is at an angle relative to a longitudinal axis of the nozzle such that the longitudinal axis of the nozzle is in a plane of the wedge-shaped notch and the fan jet exits the nozzle at an angle relative to the longitudinal axis of the nozzle; and ultrahigh-pressure tubing coupled to the fan jet nozzle to provide a conduit for the pressurized fluid.

10. The assembly according to claim 9 wherein two angled fan jet nozzles are coupled to ultrahigh-pressure tubing and directed to different walls of a kerf.

11. A method for cutting a kerf in a porous material comprising:

mounting a nozzle that generates a high pressure fluid fan jet in ultrahigh-pressure tubing;

forcing pressurized fluid through the tubing and the nozzle;

traversing a rock surface to be cut with the ultrahigh-pressure fan jet; and controlling a feed-in rate of the nozzle to maintain a standoff of between 0.25 and 0.375 inch.

12. A method for cutting a kerf in a porous material comprising:

mounting first and second fan jet nozzles that produce first and second fan jets, respectively, in a manifold at an angle relative to a vertical axis such that the fan jets are parallel to each other and form a first included angle between centerlines of the fan jets;

forcing pressurized fluid through the nozzles thereby generating the fan jets;

traversing a rock surface to be cut with the fan jets; and maintaining a sufficient standoff such that a width of a kerf cut by the fan jets is wider than a width of the manifold.

13. The method according to claim 12, further comprising:

controlling a feed-in rate of the nozzle to maintain a standoff of between 0.25 and 0.375 inch.

14. A method for cutting a kerf in a porous material comprising:

mounting first and second fan jet nozzles in a manifold at an angle relative to a vertical axis such that fan jets produced by forcing pressurized fluid through the first and second nozzles are parallel to each other and form a first included angle between centerlines of the fan jets;

mounting first and second round jet nozzles in a second manifold such that the round jets nozzles are at an angle relative to a vertical axis and round jets generated by the nozzles form a second included angle that is greater than the first included angle to further define walls of the kerf;

forcing pressurized fluid through the nozzles thereby generating the fan jets;

traversing a rock surface to be cut with the fan jets; and maintaining a sufficient standoff such that a width of a kerf cut by the fan jets is wider than a width of the manifold.

15. The method according to claim 14, further comprising:

controlling a feed-in rate of the nozzle to maintain a standoff of between 0.25 and 0.375 inch.

16. A method for cutting a kerf in a porous material comprising:

mounting a first angled fan jet nozzle in ultrahigh-pressure tubing;

mounting a second angled fan jet nozzle in ultrahigh-pressure tubing;

aligning and laterally spacing the angled fan jet nozzles such that the nozzles will direct their respective angled fan jets at opposite sides of a kerf;

forcing pressurized fluid through the ultrahigh-pressure tubing and through both nozzles;

traversing the rock to be cut with the angled fan jets; and maintaining a sufficient standoff whereby a width of the kerf cut by the angled fan jets is wider than a width of the tubing.

17. The method according to claim 16, further comprising:

controlling a feed-in rate of the nozzle to maintain a standoff of between 0.25 and 0.375 inch.

* * * * *

UNITED STATES PATENT AND TRADEMARK OFFICE

CERTIFICATE OF CORRECTION

PATENT NO. : 5,380,068

DATED : January 10, 1995

INVENTOR(S) : Chidambaram Raghavan

It is certified that error appears in the above-identified patent and that said Letters Patent is hereby corrected as shown below:

In column 10, claim 9, line 21, please delete "a".

In column 11, claim 14, line 17, please delete "jets" and subsitute therefor --jet--.

Signed and Sealed this

Nineteenth Day of September, 1995

*Attest:*

Bruce Lehman

BRUCE LEHMAN

*Attesting Officer*

*Commissioner of Patents and Trademarks*